US007474210B2

(12) United States Patent
Roberts et al.

(10) Patent No.: US 7,474,210 B2
(45) Date of Patent: Jan. 6, 2009

(54) METHOD AND SYSTEM FOR MONITORING ROOM ACTIVITY

(75) Inventors: Stuart J. Roberts, Suffern, NY (US); John Demetrops, Stony Point, NY (US); Vladimir Schuster, New City, NY (US)

(73) Assignee: Monismart Systems LLC, Stony Point, NY (US)

( * ) Notice: Subject to any disclaimer, the term of this patent is extended or adjusted under 35 U.S.C. 154(b) by 0 days.

(21) Appl. No.: 11/973,226

(22) Filed: Oct. 5, 2007

(65) Prior Publication Data

US 2008/0117045 A1 May 22, 2008

Related U.S. Application Data

(63) Continuation-in-part of application No. 11/340,962, filed on Jan. 26, 2006, which is a continuation of application No. 10/340,272, filed on Jan. 10, 2003, now Pat. No. 7,075,432.

(51) Int. Cl.
*G08B 13/14* (2006.01)

(52) U.S. Cl. ..... 340/568.1; 340/572.1; 340/5.6; 235/385

(58) Field of Classification Search ..... 340/568.1, 340/572.1, 10.1, 5.73, 999, 5.6; 235/385; 70/1, 57, 57.1, 91
See application file for complete search history.

(56) References Cited

U.S. PATENT DOCUMENTS 3,739,329 A 6/1973 Lester
4,598,275 A 7/1986 Ross et al.
4,636,950 A 1/1987 Caswell et al.
5,397,884 A * 3/1995 Saliga ..... 235/382.5
5,614,703 A 3/1997 Martin et al.
5,708,423 A 1/1998 Ghaffari et al.
5,802,147 A 9/1998 Beyda et al.
6,064,316 A * 5/2000 Glick et al. ..... 340/5.65

(Continued)

OTHER PUBLICATIONS

Mitchell, Robert, "It's Just the Key to Your Room", http//www.computerworld.com/securitytopics/security/story/0,10801,107701,00.html, Jan. 16, 2006.

*Primary Examiner*—Eric M Blount
(74) *Attorney, Agent, or Firm*—Mathews, Shepherd, McKay & Bruneau, P.A.

(57) ABSTRACT

The invention relates to a method and system for monitoring room activity. A tray sensing device detects the presence of a tray in a given location and forwards the information to a tray controller. The tray can be a conventional tray for supporting food articles or can be supported or integral with a food cart. The system also includes monitoring door lock and door tag information. Information from the tray sensing device, door lock/tag controller and is received at a room controller. The room controller of each room can include a wireless network to the tray controller, door lock/tag controller. The room controller can also monitor information of the room such as, for example, temperature information and light intensity information, and receive information regarding room activities, such as, for example, room service ordering, housekeeping minibar and checkout routine. Information from the room controller can be forwarded to a central information system. The central information system can display the information or activate an alarm. The alarm can be an audio or visual alert. The alarm can be deactivated upon removal of the tray from the given location or upon dispatching of personnel to the given location.

24 Claims, 4 Drawing Sheets

U.S. PATENT DOCUMENTS

| | | | | |
|---|---|---|---|---|
| 6,102,162 | A | 8/2000 | Teicher | |
| 6,107,929 | A | 8/2000 | Amari | |
| 6,152,321 | A | 11/2000 | Staar | |
| 6,351,215 | B2 | 2/2002 | Rodgers et al. | |
| 6,433,689 | B1 | 8/2002 | Houind et al. | |
| 6,437,692 | B1 | 8/2002 | Petite et al. | |
| 6,577,238 | B1 * | 6/2003 | Whitesmith et al. | 340/572.1 |
| 6,714,121 | B1 | 3/2004 | Moore | |
| 7,049,933 | B1 | 5/2006 | Koerner | |
| 7,061,393 | B2 * | 6/2006 | Buckingham et al. | 340/693.3 |
| 7,075,432 | B2 | 7/2006 | Roberts et al. | |
| 7,084,740 | B2 | 8/2006 | Bridgelall | |
| 7,170,407 | B2 * | 1/2007 | Wagner | 340/539.13 |
| 2004/0003257 | A1 * | 1/2004 | Mitchell | 713/182 |
| 2004/0046018 | A1 * | 3/2004 | Dobbins | 235/382.5 |
| 2005/0035862 | A1 * | 2/2005 | Wildman et al. | 340/573.1 |
| 2005/0150952 | A1 * | 7/2005 | Chung | 340/572.1 |
| 2006/0125635 | A1 | 6/2006 | Roberts et al. | |
| 2006/0226988 | A1 * | 10/2006 | Ernst et al. | 340/572.1 |
| 2006/0290471 | A1 * | 12/2006 | Van Alstyne | 340/572.1 |
| 2007/0004518 | A1 * | 1/2007 | Friesen et al. | 463/42 |
| 2007/0018787 | A1 | 1/2007 | Cortina et al. | |

* cited by examiner

METHOD AND SYSTEM FOR MONITORING ROOM ACTIVITY

CROSS-REFERENCE TO RELATED APPLICATION

This application is a continuation-in-part U.S. patent application Ser. No. 11/340,962 filed Jan. 26, 2006, which is a continuation of U.S. patent application Ser. No. 10/340,272 filed Jan. 10, 2003 now U.S. Pat. No. 7,075,432, which is hereby incorporated by reference in its entirety into this application.

BACKGROUND OF THE INVENTION

1. Field of the Invention

The present invention relates to a method and system for monitoring room activity including monitoring food tray activity in which a sensor detects the presence or absence of a food tray in a hallway, such as in a hotel or motel and monitoring of door lock, door tag and room information. (i.e., Temperature, humidity, light info, Minibar status etc.).

2. Background of the Invention

Typically, food is delivered on trays to patrons in rooms of hotels by room service. Conventionally, after the patron has finished the food, the tray holding the used dishes and any uneaten food is placed in the hallway. Thereafter, the tray is picked up at some point by housekeeping or room service. The disadvantage of this method is that housekeeping or room service are unaware when the patron has finished the meal and do not know when to pick up the tray from outside the patron's room. Accordingly, it can be several hours before the tray is picked up resulting in unsightly trays being in the hallways and observed by other patrons of the hotel, as well as uneaten food having the possibility of spoiling and drawing pests or rodents.

Conventional electronic door locks used in a hotel typically are stand alone battery powered devices. Each door lock contains a sequence of lock codes. The sequence advances when an expired card is swiped or a new card is inserted. The lock can log when a guest, maid or other hotel employee has entered the room. Conventional hotel door locks are not wired to the systems at the front desk. Therefore, if a card is lost and a new card is issued, the room remains unprotected until the new card is inserted into the lock and it resets.

U.S. Pat. No. 5,614,703 describes a method and apparatus for a guest having a valid general purpose credit card to register at a place of lodging having a computer, and which uses the general purpose credit card as a key to the assigned room. The method involves the inserting of a general purpose credit card into a card reader of a guest accessible registration terminal, the card reader reading the credit card information and delivering the information to a computer. The computer stores the card information, and the terminal, by means of registration software obtains further information from the guest, assigns the guest a room, and informs the guest of the room assignment, after which the credit card becomes a key to the guest room. When the credit card is inserted in the proper card reader at the assigned guest room door, the computer will actuate the lock and allow the guest access. A paging transmitter forwards information wirelessly from the computer to a paging receiver electrically connected to the card reader of the assigned room.

It is desirable to provide a room information system for monitoring food tray activity, lock status, door tag and room information wherein such system can alert a central location.

SUMMARY OF THE INVENTION

The invention relates to a method and system for monitoring room activity. A tray sensing device detects the presence of a tray in a given location and forwards the information to a room controller. The tray can be a conventional tray for supporting food articles or can be supported or integral with a food cart. The system also includes monitoring door lock and door tag information. Information from the tray sensing device, door lock/tag controller is received at the room controller. The room controller of each room can include a wireless network to the tray controller, door lock/tag controller. The room controller can also monitor information of the room such as, for example, temperature humidity and light intensity information, and receive information regarding room activities, such as, for example, room service ordering and status, housekeeping, minibar and checkout routine. Information from the room controller can be forwarded to a host controller. The host controller can display the information, activate an alarm or separate and send data to relevant controllers located, for example at security, service, housekeeping and front desk. The alarm can be an audio or visual alert. The alarm can be deactivated upon removal of the tray from the given location or acknowledgement of request.

The invention will be more fully described by reference to the following drawings.

DETAILED DESCRIPTION

Figure 1:
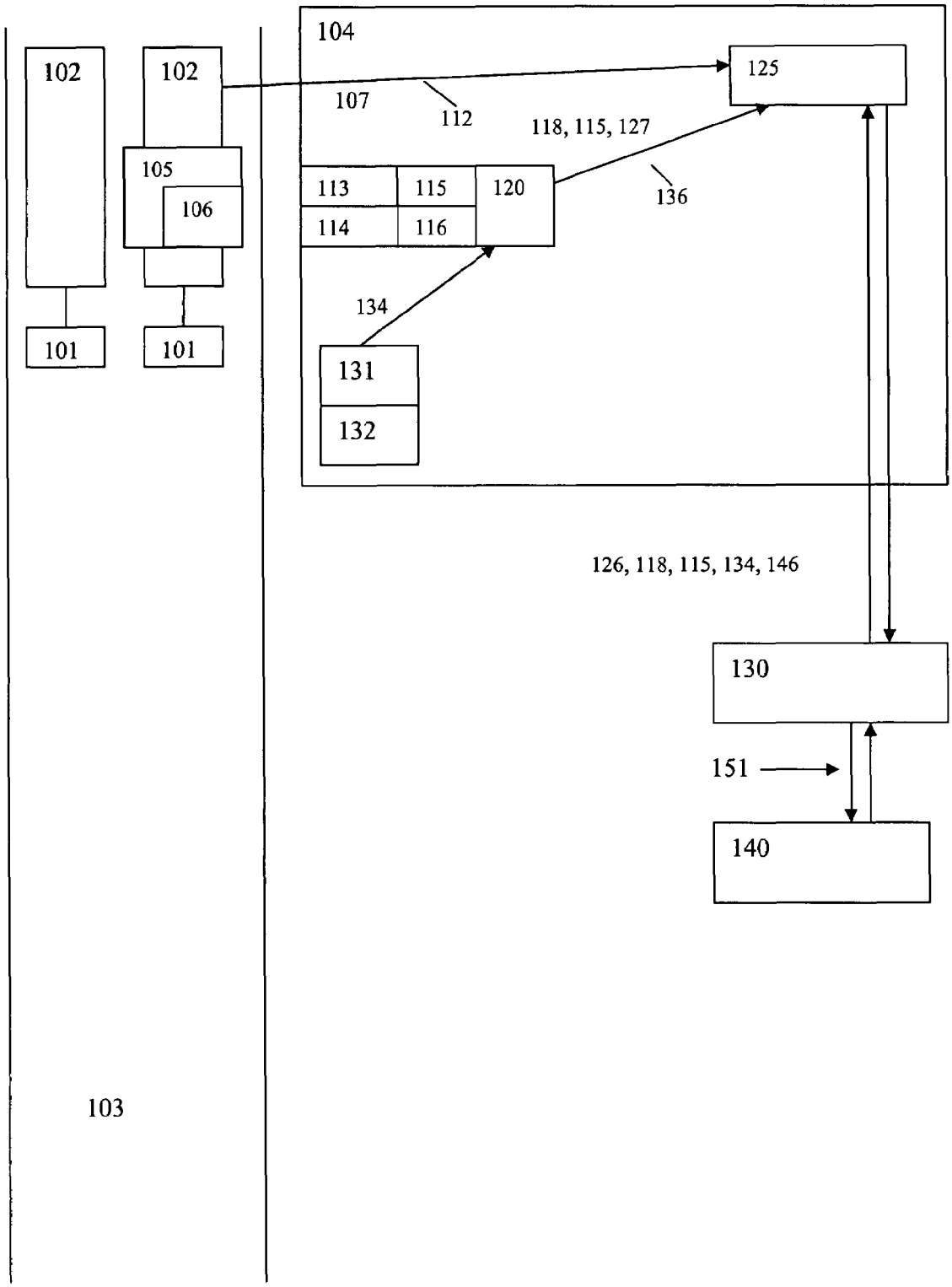
FIG. 1 is a schematic diagram of a system for monitoring tray, lock and door tag activity in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts. Like reference numerals will be used in figures of the invention.

FIG. 1 is a schematic diagram of room information system 100 in accordance with the teachings of the present invention. Tray sensing device 101 is positioned in hallway 103. In one embodiment tray sensing device 101 comprises floor antennas 102. For example, floor antenna 102 can be a flat ribbon cable. Floor antenna 102 can be positioned underneath floor covering in hallway 103. Alternatively, antenna 102 can be positioned on the top surface of hallway 103 or integral with hallway 103.

In one embodiment tray RFID device 106 is coupled to food tray 105. For example, tray RFID device 106 can be a resonant device, which is read by floor antenna 102. In an alternate embodiment, tray sensing device 101 and tray RFID device 106 can be a transmitter or receiver for respectively sending or receiving a signal for determining the presence or absence of food tray 105 within a predetermined distance from tray sensing device 101. In this embodiment, the transmitter and receiver can communicate over a wireless or wired connection. It will be appreciated by those skilled in the art that other implementations of a tray sensor and tray sensing device can be used with the teachings of the present invention.

Floor antennas 102 are located in hallway 103 in front of room 104. Floor antenna 102 senses the presence of food tray 105. Floor antenna 102 detects tray information 107 of the presence of food tray 105. Tray sensing device 101 forwards tray information 107 about the presence of food tray 105 to room controller 125 over communication path 112. Room controller 125 associates a room address with tray information 107. Room controller 125 forwards this information to host controller 130 over connection 126.

Lock 113 is associated with room 104 and mounted on door 111. Lock 113 can be a conventional electronic lock operated by door lock card 114. For example, an electronic lock system manufactured by ONITY, INC. or Assa Abloy can be used with the teachings of the present invention. Door lock/tag controller 120 monitors activity of door lock card 114. Each time lock 113 is deactivated by door lock card 114 door lock/tag controller 120 sends lock identification 118 of lock 113 and card entry code 115 to room controller 125 over connection 136. Room controller 125 forwards lock identification 118 and card entry code 115 to host controller 130 over connection 126. Host controller 130 can store lock identification 118 and card entry code 115 in memory at host controller 130. Accordingly, system 100 archives each access event to a room into memory with time and date stamp. This information can be used by security or management and can be transferred to service host controller 140.

In the case in which lock 113 is not deactivated by door lock card 114, door lock/tag controller 120 sends lock identification 118 of lock 113 and card entry code 115 to room controller 125. Room controller 125 associates a room address with lock identification 118 and card entry code 115. Room controller 125 forwards lock identification 118 of lock 113 and card entry code 115 to host controller 130 which can be transferred to service host controller 140 to notify a security service.

Conventional systems currently work such that when door lock card 114 is issued it has a unique entry code for the particular room 104. In the present invention, when a new door lock card 114 is issued the unique information from that particular door lock card 114 is encoded and with lock identification 118 forwarded from service host controller 140 via host controller 130 and room controller 125 to door lock/tag controller 120. Door lock/tag controller 120 can store different entries of lock identification 118.

Lock 113 can be powered by battery 116. Door lock/tag controller 120 monitors power of battery 116. Door lock/tag controller 120 sends alert 127 to room controller 125 when power is below a certain voltage threshold, for example, less than 3.9 volts.

Door tag 131 can be associated with different service requests (for example "Do not disturb", "Breakfast Request", "Make Up Room" etc.). Door tag 131 includes an associated RFID tag 132. Door lock/tag controller 120 monitors door tag 131 and received door tag information 134. Door tag information 134 of RFID tag 132 can be forwarded to room controller 125 over connection 136. Room controller 125 forwards door tag information 134 to host controller 130 for immediate processing of door tag information 134.

Figure 2:
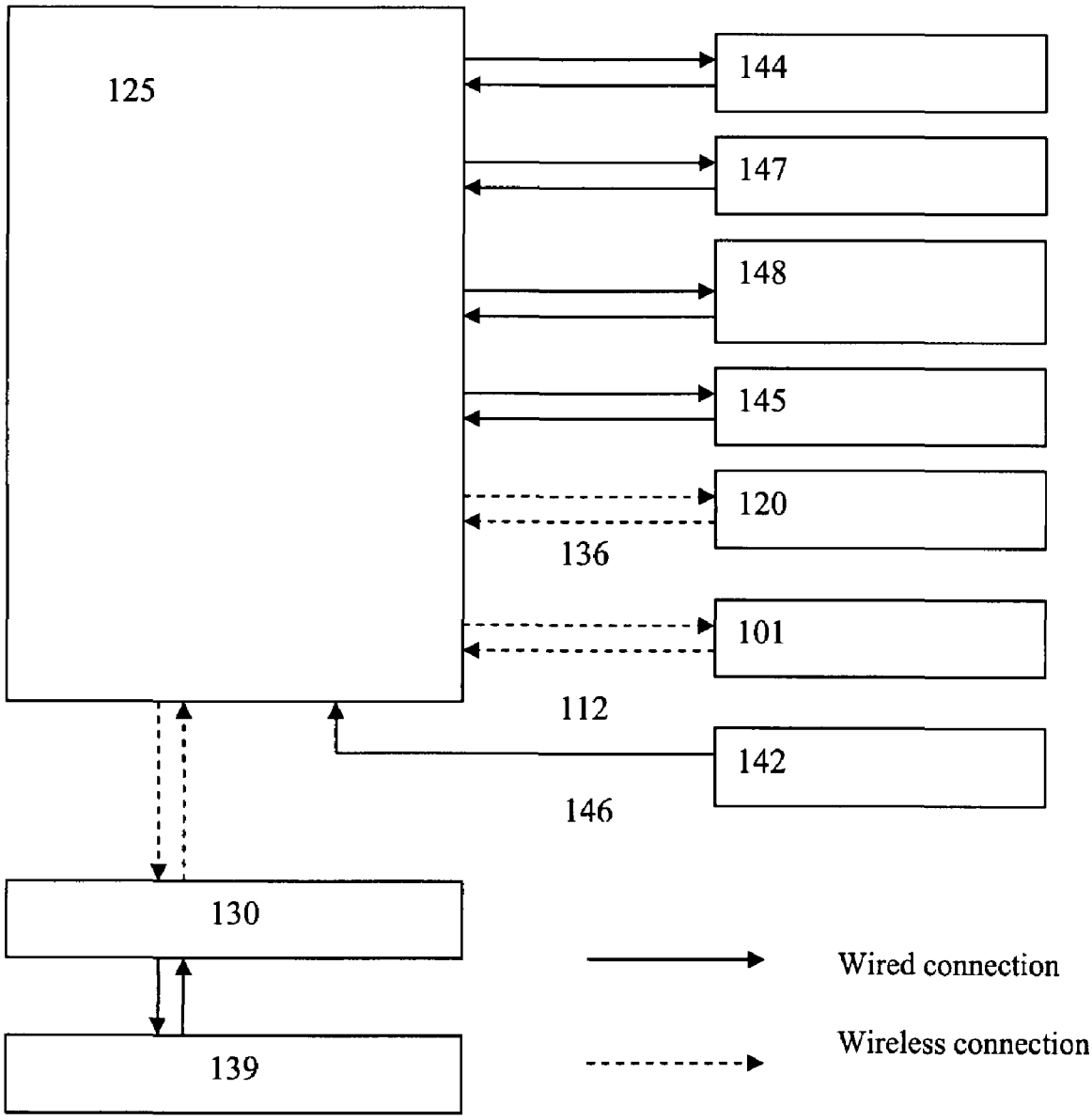
FIG. 2 is a schematic diagram of an embodiment of a room controller.

Room controller 125 is a separate device that can activate and monitor different parameters in room, as shown in FIG. 2. Room controller 125 can be powered by 110 volts and can be plugged in anywhere in room 104. Room controller 125 can include screen display 139 and navigation device 142 to scroll through a menu of services and options. Room controller 125 can have a plurality of connections, wire or wireless connections to sensors and controllers in order to process room information from the various devices and to forward the information from each to host controller 130 for processing and distribution to the relevant services host controllers 140. Room controller 125 can include sensor 144 to transmit room temperature information. Room controller 125 can include sensor 145 to transmit room light intensity. Room controller 125 can include sensor 147 to transmit room humidity information. Room controller 125 can include sensor 148 to transmit mini bar information. Navigation device 142 can be used to input room information 146 at room controller 125. For example, room information 146 can include information on room service ordering, housekeeping, minibar, and check out routine.

Connections 112, 126 and 136 can be wired or wireless connection, as shown in FIG. 1. As described above, room controller 125 receives tray information 107 from tray sensing device 101; lock identification 118, card entry code 115 and door tag information 134 from door lock/tag controller 120 which information can be received over a wireless connection.

For example, host controller 130 can be connected with wireless connection 126 to room controller 125. It will be appreciated that a predetermined number of rooms can be connected to host controller 130. Host controller 130 can be located, for example at the front desk or hotel manager's office. Host controller 130 can forward tray information 107, lock identification 118, card entry code 115, room information 146 and door tag information 134 to one or more service host controllers 140. Service host controllers 140 can be located at service areas of the hotel, for example, at room service, housekeeping, concierge, front desk, security, and the like. Service host controllers 140 use tray information 107, lock identification 118, card entry code 115, door tag information 134 and room information 146 for performing tasks. Once tasks are accomplished, service host controller 140 send confirmation information 151 to host controller 130. Host controller 130 forwards confirmation information 151 to room controller 125.

Figure 3:
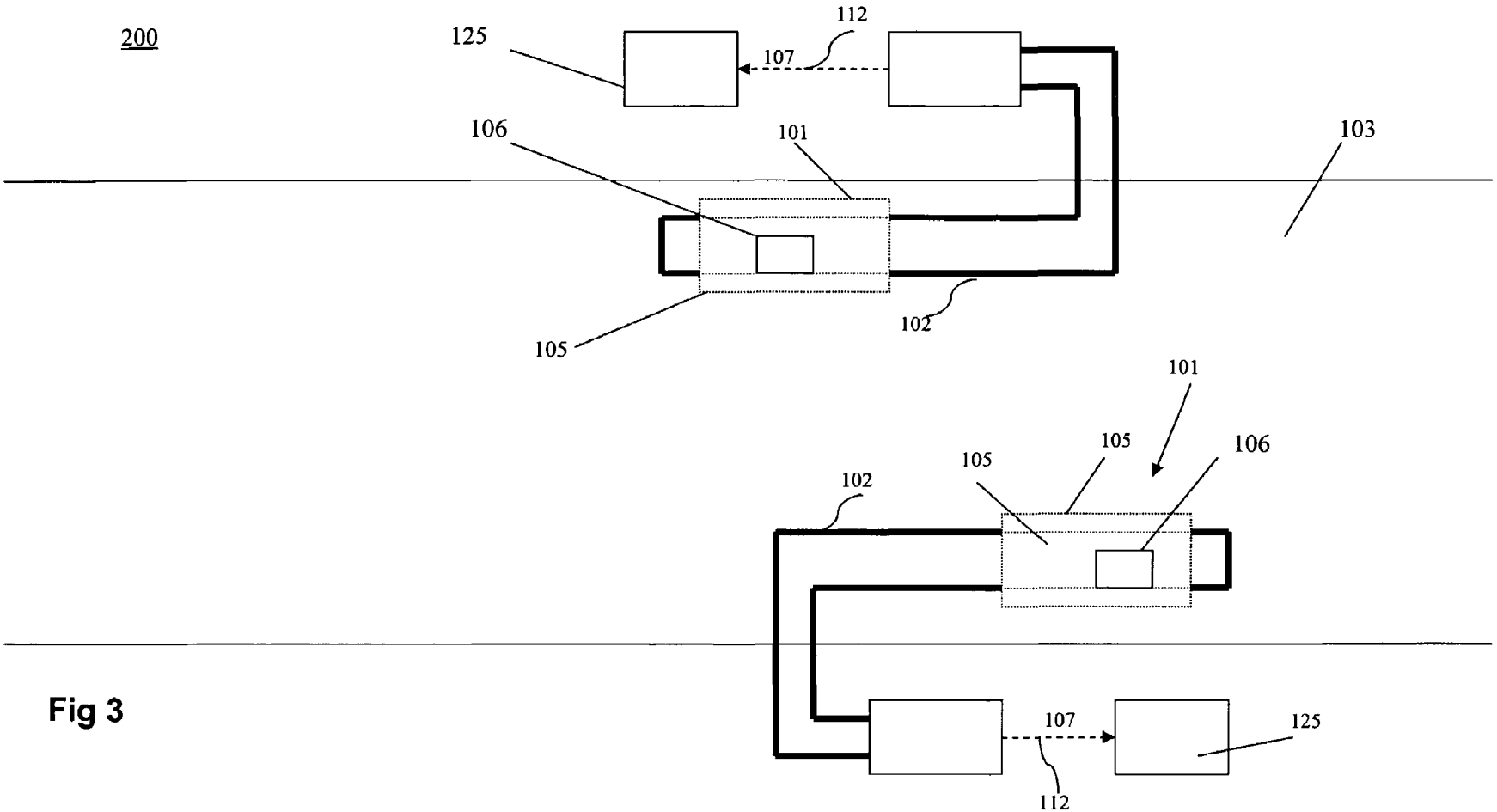
FIG. 3 is a schematic diagram of a plurality of tray sensor devices associated with a hallway.

FIG. 3 illustrates an embodiment of a plurality of tray controllers positioned along a hallway which can be used in room information system 200. Tray sensing device 101 includes antenna 102. For example, antenna 102 can be a flat ribbon cable. Antenna 102 can be positioned underneath floor covering in hallway 103. Alternatively, antenna 102 can be positioned on the top surface of hallway 103 or integral with hallway 103

Tray RFID device 106 is coupled to surface 110 of food tray 105. For example, tray RFID device 106 can be a resonant device which is read by antenna 102. In an alternate embodiment, tray sensing device 101 can be a transmitter or receiver for respectively sending or receiving a signal for determining the presence or absence of food tray 105 within a predetermined distance from tray sensing device 101. In this embodiment, the transmitter and receiver can communicate over a wireless or wired connection. It will be appreciated by those skilled in the art that other implementations of a tray sensor and tray sensing device can be used with the teachings of the present invention.

Upon sensing food tray 105, tray sensing device 101 forwards tray information 107 to room controller 125 over communication path 112. Tray information 107 can be generated at tray sensing device 101 to provide information about the room 104 location of food tray 105 along hallway 103. Communication path 112 can be a wired or wireless connection.

Figure 4:
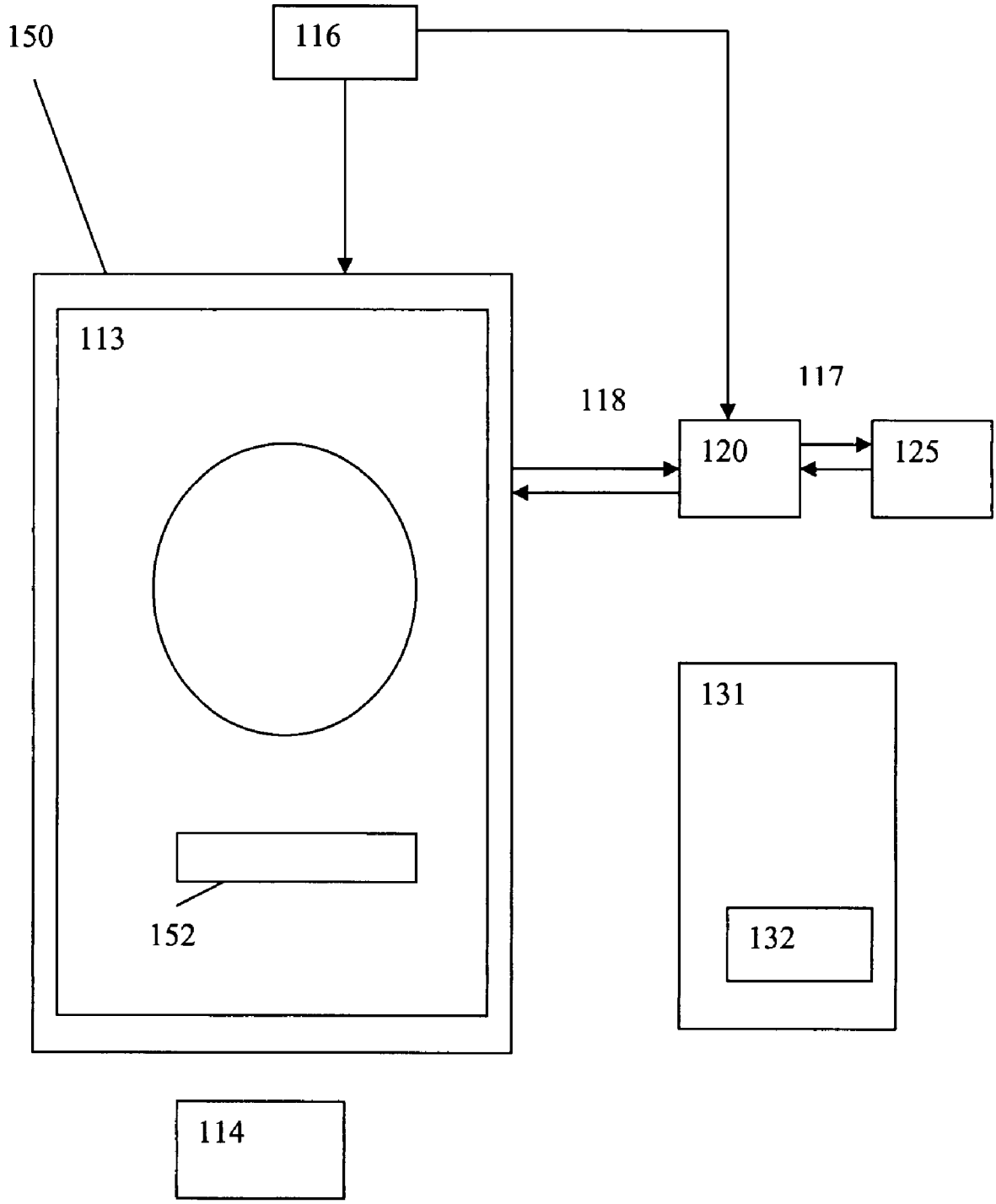
FIG. 4 is a schematic diagram of a lock and door lock/tag controller.

FIG. 4 is a schematic diagram of a lock 113 and door lock/tag controller 120. Lock 113 is fitted with lock antenna 150 which surrounds lock 113. Lock 113 can be a conventional lock. Door lock card 114 can be inserted in slot 152. Lock antenna 150 reads information from RFID tag 132 which is attached to the back of door tag 131. Door tag 131 can be a conventional door tag which can be inserted into a slot in lock 113 or received around a handle of lock 113. Door lock/tag controller 120 receives lock identification and door information 134 from lock antenna 150 and then forwards the information to room controller 125 for further processing and review to the host controller 130. If necessary host controller 130 sends information to relevant service controllers 140.

The major benefit of this system is that it enables hotels to use their existing systems for lock and door tag information. The system works within the current limitations and benefits current activities while utilizing the information and processing it to provide faster and better services to the hotel customer while reducing labor costs for the hotel.

It is to be understood that the above-described embodiments are illustrative of only a few of the many possible specific embodiments which can represent applications of the principles of the invention. Numerous and varied other arrangements can be readily devised in accordance with these principles by those skilled in the art without departing from the spirit and scope of the invention.

What is claimed is:

1. A method for monitoring room activity comprising the steps of:

providing a tray sensing device for sensing a tray in a vicinity of the tray sensing device, said tray sensing device adapted for communicating tray information of the presence of a tray to a tray controller;

providing a door lock, said door lock being activated by a door lock card, said door lock adapted for communicating door lock information of said door lock card to a door lock/tag controller;

providing a door tag, said door tag including an associated RFID tag, said RFID tag adapted for communicating door tag information of said RFID tag to said door lock/tag controller;

a room controller receiving one or more of said tray information from said tray controller, said door lock information from said door lock/tag controller and said door tag information from said door lock/tag controller, and associating a room address with said tray information, said door lock information and said door tag information; and forwarding said associated room address and said tray information, said door lock information and said door tag information from said room controller to a central information system.

2. The method of claim 1 further comprising the step of:

activating an alarm at said host controller upon receipt of said one or more of said tray information from said tray controller, said door lock information from said door lock/tag controller and said door tag information from said door lock/tag controller, said room controller.

3. The method of claim 2 further comprising the step of:

deactivating said alarm upon receipt of second information from a respective one or more of said tray controller, said door lock/tag controller, said door lock/tag controller and said room controller.

4. The method of claim 1 further comprising the step of:

continuing to forward said tray information from said tray sensing device while said tray is at said given location until said tray is removed from said given location and deactivating said alarm when said information is no longer forwarded.

5. The method of claim 2 further comprising the step of deactivating said alarm upon dispatching of personnel to said given location.

6. The method of claim 1 wherein said tray sensing device further comprises a tray sensor coupled to a surface of said tray, said tray sensing device is positioned at said given location and said tray sensing device reads said tray sensor.

7. The method of claim 6 wherein said given location is a hallway and said tray sensing device is an antenna positioned in said hallway, said antenna reads said tray sensor.

8. The method of claim 7 wherein said tray sensing device and said tray sensor is respectively either a transmitter or a receiver for sending or receiving a signal.

9. The method of claim 1 wherein said door lock card includes a unique card entry code.

10. The method of claim 9 further comprising the step of storing said door lock information received at said central information system in memory of said central information system.

11. The method of claim 9 further comprising the steps of determining if said door lock card deactivated said door lock;

if said door lock card did not deactivate said door lock, forwarding from said door lock/tag controller an identification of said door lock and said card entry code to said room controller;

forwarding said identification of said door lock and said card entry code to said central information system;

determining if said identification of said door lock and said card entry code are correct, if said identification of said door lock and said card entry code are correct, forwarding lock activation information from said central information system to said room controller; said lock activation information being used to activate said door lock card.

12. The method of claim 11 further comprising the step of monitoring power of a battery of said door lock with said door lock/tag controller; and if said power is below a threshold, forwarding an alert from said door lock/tag controller to said room controller.

13. The method of claim 1 further comprising the steps of:

sensing room temperature information with said room controller; and forwarding said room temperature information from said room controller to said central information system.

14. The method of claim 1 further comprising the steps of:

sensing room light intensity information with said room controller; and forwarding said room light intensity information from said room controller to said central information system.

15. The method of claim 1 further comprising the step of:

navigating a screen display of said room controller for inputting room information at said room controller; and forwarding said room information to said central information system.

16. A system for monitoring room activity comprising:

a tray sensing device for sensing a tray in a vicinity of the tray sensing device, said tray sensing device adapted for communicating tray information of the presence of a tray to a tray controller;

a door lock, said door lock being activated by a door lock card, said door lock adapted for communicating door lock information of said door lock card to a door lock/tag controller;

a door tag, said door tag including an associated RFID tag, said RFID tag adapted for communicating door tag information of said RFID tag to a lock/tag door; and a room controller receiving one or more of said tray information from said tray controller, said door lock information from said door lock/tag controller and said door tag information from said door lock/tag controller, and associating a room address with said one or more of said tray information, said door lock information and said door tag information; and means for forwarding said associated room address and said tray information, said door lock information and said door tag information from said room controller to a central information system.

17. The system of claim 16 wherein said tray controller, said door lock/tag controller, and said door lock/tag controller are connected to said room controller with a wireless network.

18. The system of claim 16 further comprising:

means for activating an alarm at said central information system upon receipt of said one or more of said tray information from said tray controller, said door lock information from said door lock/tag controller and said door tag information from said door lock/tag controller, said room controller.

19. The system of claim 18 further comprising:

means for deactivating said alarm upon receipt of second information from a respective one or more of said tray controller, said door lock/tag controller, said door lock/tag controller or said room controller.

20. The system of claim 16 wherein said tray sensing device further comprises a tray sensor coupled to a surface of said tray, said tray sensing device is positioned at said given location and said tray sensing device reads said tray sensor.

21. The system of claim 20 wherein said given location is a hallway and said tray sensing device is an antenna positioned in said hallway, said antenna reads said tray sensor.

22. The system of claim 21 wherein said tray sensing device and said tray sensor is respectively either a transmitter or a receiver for sending or receiving a signal.

23. The system of claim 20 wherein said door lock card includes a unique card entry code.

24. The system of claim 20 further comprising means for monitoring power of a battery of said door lock with said door lock/tag controller; and means for forwarding an alert from said door lock/tag controller to said room controller if said power is below a threshold.

* * * * *